US010703543B1

(12) United States Patent
Hulme, Sr.

(10) Patent No.: US 10,703,543 B1
(45) Date of Patent: Jul. 7, 2020

(54) COLLAPSIBLE FUEL CONTAINER

(71) Applicant: Leonard Dale Robert Hulme, Sr., Corunna (CA)

(72) Inventor: Leonard Dale Robert Hulme, Sr., Corunna (CA)

( * ) Notice: Subject to any disclaimer, the term of this patent is extended or adjusted under 35 U.S.C. 154(b) by 0 days.

(21) Appl. No.: 16/371,086

(22) Filed: Mar. 31, 2019

(51) Int. Cl.
*B65D 33/08* (2006.01)
*B65D 37/00* (2006.01)
*B65D 39/00* (2006.01)
*B65D 43/18* (2006.01)

(52) U.S. Cl.
CPC ..... *B65D 37/00* (2013.01); *B65D 33/08* (2013.01)

(58) Field of Classification Search
CPC ..... B65D 33/08; B65D 37/00; B65D 39/00; B65D 39/08; B65D 43/18
USPC ..... 222/519–525, 531–532, 537, 548–549, 222/460–462, 142.1–142.9, 464.1, 464.5
See application file for complete search history.

(56) References Cited

U.S. PATENT DOCUMENTS 1,883,534 A * 10/1932 Burke ..... B65D 47/265 222/520
4,613,063 A * 9/1986 Wright ..... B65D 47/265 220/270
4,655,418 A * 4/1987 Melahn ..... B64D 1/14 206/523
4,925,068 A * 5/1990 Schneider ..... B65D 47/261 222/153.14
5,058,778 A * 10/1991 Weinstein ..... B65D 83/00 222/209
5,176,277 A * 1/1993 Schuermann ..... B65D 47/265 220/253
5,350,091 A * 9/1994 Leete ..... B65D 25/385 141/337
5,967,370 A * 10/1999 Nettles ..... B65D 37/00 206/38
6,039,210 A * 3/2000 Flowers ..... B65D 37/00 222/1
6,622,988 B2 * 9/2003 Gill ..... A47G 21/185 220/703
6,929,159 B1 * 8/2005 Haig ..... B65D 47/265 141/18
7,114,703 B2 * 10/2006 Ciesielka ..... F16K 1/50 251/344
8,517,228 B2 * 8/2013 Attie ..... G01F 11/22 222/370

(Continued)

*Primary Examiner* — Paul R Durand
*Assistant Examiner* — Andrew P Bainbridge
(74) *Attorney, Agent, or Firm* — Gulf Coast Intellectual Property Group

(57) ABSTRACT

A collapsible fuel container that is configured to be transitioned intermediate a first position and a second position wherein its first position the collapsible fuel container is rolled for storage. The fuel container includes a body having a wall defining an interior volume. The body is manufactured from a flexible material and has opposing ends. A rotatable fill nozzle is operably coupled with a dip tube wherein the rotation thereof permits the flow of fluid or inhibits the flow of fluid. A dip tube is fluidly coupled to the fill nozzle and is disposed within the interior volume of the body. A first block member is on an end of the fill nozzle and a second block member is on an end of the dip tube. The rotatable movement of the fill nozzle transitions the orientation of the first block member to the second block member.

14 Claims, 3 Drawing Sheets

(56) References Cited

U.S. PATENT DOCUMENTS

| | | | | |
|---|---|---|---|---|
| 8,622,249 | B1 * | 1/2014 | Ballentine | A45F 3/20<br>222/145.5 |
| 8,622,260 | B2 * | 1/2014 | Maietta | A47K 5/18<br>222/547 |
| 2005/0150889 | A1 * | 7/2005 | Perra | B65D 17/28<br>220/254.1 |

* cited by examiner

COLLAPSIBLE FUEL CONTAINER

FIELD OF THE INVENTION

The present invention relates generally to liquid storage containers, more specifically but not by way of limitation, a collapsible container configured to receive and store liquid such as but not limited to gasoline wherein the collapsible container is operable to be stored in a rolled position so as to minimize the space required when not in use.

BACKGROUND

As is known in the art, there are many types of objects that utilize combustible fuels for operation. From vehicles to motorcycles and countless other devices such as but not limited to lawn equipment. The aforementioned all utilize combustible fuel such as gasoline for operation thereof. Many devices that utilize fuel for operation have small integrate gas tanks and the operator thereof must transport fuel from a filling station to the location where the device is located and provide repeated filling thereof during use. Conventional plastic and metal gas cans are utilized for this task and these are commonly available in various sizes ranging from one gallon to five gallons. In addition to providing gas for smaller devices, gas cans are often stored and kept on hand in the event that an individual operating a motor vehicle may run out of gas. When an automobile runs out of gas these gas cans are utilized to retrieve fuel from a filling station and transport the fuel to the location of the vehicle wherein the fuel is deposited into the fuel tank of the vehicle.

One issue with conventional gas cans is the space required to provide storage thereof. Even a smaller gas can will consume several cubic feet of storage space. If an individual has a small automobile with reduced storage this space can be a premium. The consumption of space by the gas can reduces the ability for the owner to store items such as but not limited to groceries and luggage. As these conventional gas cans can require space for storage many individuals decide not to maintain possession of a gas can in their vehicle and when needed do not have a solution to obtain fuel and transport back to their vehicle.

Accordingly, there is a need for a collapsible fuel container that is configured to be stored in a rolled position so as to reduce the space required for storage thereof and further be deployed to an operable position wherein a user can place fuel therein for transport to a desired location.

SUMMARY OF THE INVENTION

It is the object of the present invention to provide a collapsible fuel container configured to have a first position and a second position wherein the fuel container includes a body having a wall forming an interior volume.

Another object of the present invention is to provide a fuel container that is configured to receive and store a fuel or other liquid wherein the body is manufactured from a rubber or other suitable material.

A further object of the present invention is to provide a collapsible fuel container configured to have a first position and a second position wherein in the first position the body of the fuel container is in a rolled position.

Still another object of the present invention is to provide a fuel container that is configured to receive and store a fuel or other liquid wherein in the second position the body is expanded so as to receive fuel therein.

An additional object of the present invention is to provide a collapsible fuel container configured to have a first position and a second position that further includes a fill nozzle wherein the fill nozzle is sealably coupled to the body and is further configured to have telescopic segments.

Yet a further object of the present invention is to provide a fuel container that is configured to receive and store a fuel or other liquid wherein the body further includes a sealed aperture journaled therethrough so as to provide an element for engagement of a human finger.

Another object of the present invention is to a provide a collapsible fuel container configured to have a first position and a second position wherein the fill nozzle has operably coupled thereto a dip tube that is configured to fluidly couple the fill nozzle with the interior volume of the body.

An alternate object of the present invention is to provide a fuel container that is configured to receive and store a fuel or other liquid wherein the fill nozzle is rotatable so as to provide a technique to allow fluid to egress from the fill nozzle or to provide sealing thereof.

Still a further object of the present invention is to provide a collapsible fuel container configured to have a first position and a second position wherein the body further includes a handle member formed thereon.

An additional object of the present invention is to provide a fuel container that is configured to receive and store a fuel or other liquid wherein the body includes opposing straps secured thereto wherein the opposing straps are operable to maintain the body in its first position.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
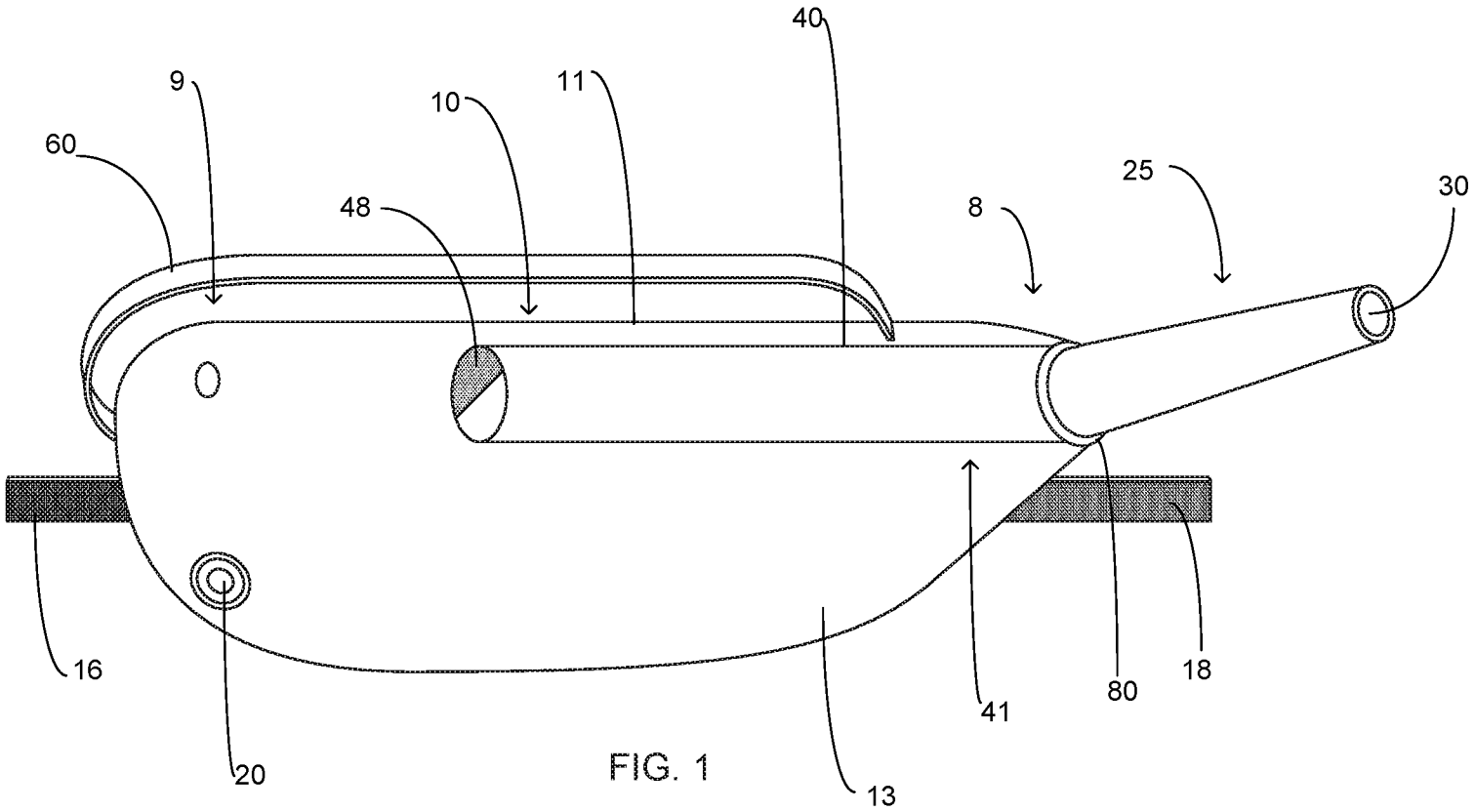
FIG. 1 is perspective view of a preferred embodiment of the present invention.

Referring now to the drawings submitted herewith, wherein various elements depicted therein are not necessarily drawn to scale and wherein through the views and figures like elements are referenced with identical reference numerals, there is illustrated a collapsible fuel container 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring in particular to the Figure submitted herewith, the collapsible fuel container 100 includes a body 10. The body 10 is defined by wall 11 and is manufactured from a flexible solvent resistant material such as but not limited to rubber. It is contemplated within the scope of the present invention that the collapsible fuel container 100 could be utilized to receive and store many types of liquids but in a preferred embodiment the collapsible fuel container 100 is utilized to receive and store fuel. As such in a preferred embodiment the body 10 is manufactured from a rubber material that is resistant to degradation from fuel or solvents. Those skilled in the art will recognize that numerous types of rubber could be utilized to manufacture the body 10.

The body 10 is configured to have a first position and a second position. In FIG. 1 herein, the body 10 is illustrated in its second position. In the second position body 10 is expanded so as to receive fuel in the interior volume 13 thereof. In the first position of the body 10 (not particularly illustrated herein) the body 10 is moved to a rolled position wherein subsequent be moved to a rolled position the straps 16,18 are utilized to encircle the body 10 and provide securing of the body 10 in its first position. The straps 16, 18 are rectangular in shape and utilize material such as but not limited to hook and loop material in order to secure to each other and maintain the body 10 in its rolled position. While no particular size of the body 10 is required, it is contemplated within the scope of the present invention that the body 10 is provided in sizes of two to five gallons.

Journaled through the wall 11 of the body 10 is holding aperture 20. The holding aperture 20 is sealably formed through the body 10 wherein a user can journal a finger or other element therethrough as needed to engage the collapsible fuel container 100 during use thereof. The holding aperture 20 is sealably formed utilizing suitable techniques such as but not limited to chemical welding. It is contemplated within the scope of the present invention that the holding aperture 20 could be formed in alternate sizes.

Figure 3:
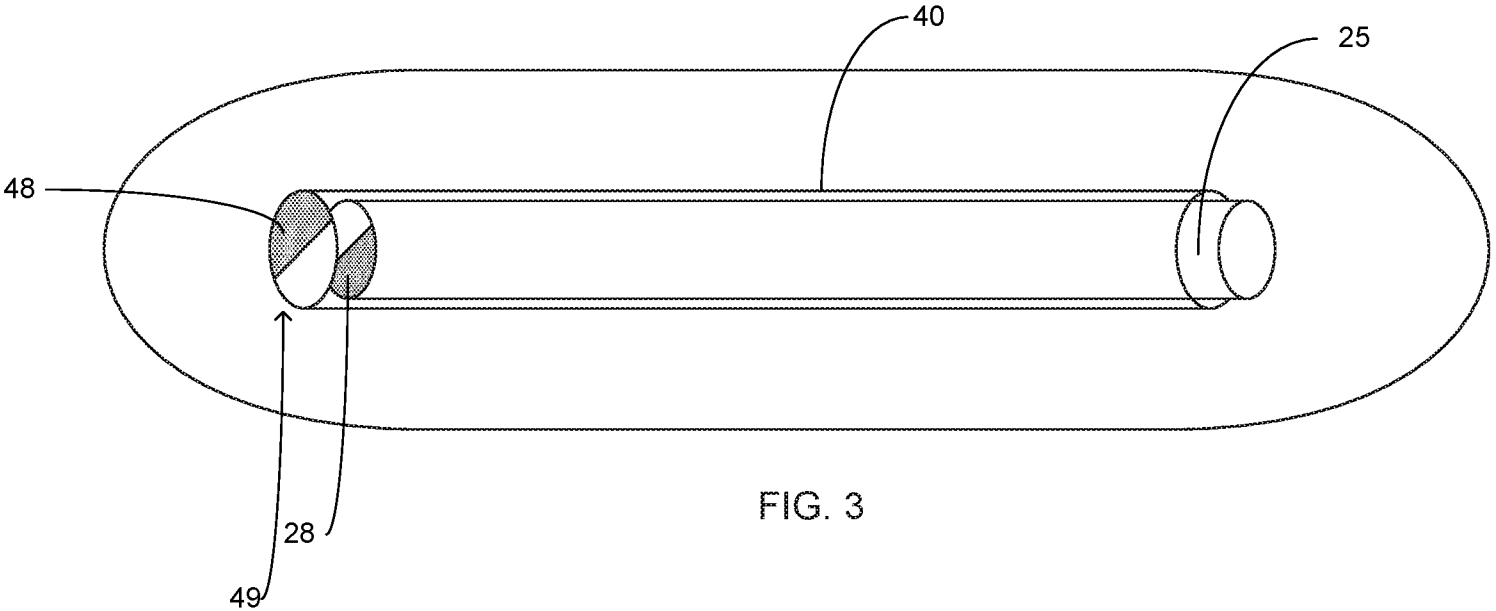
FIG. 3 is a side view of the fill nozzle of the present invention moved to its second position within the dip tube.
Figure 4:
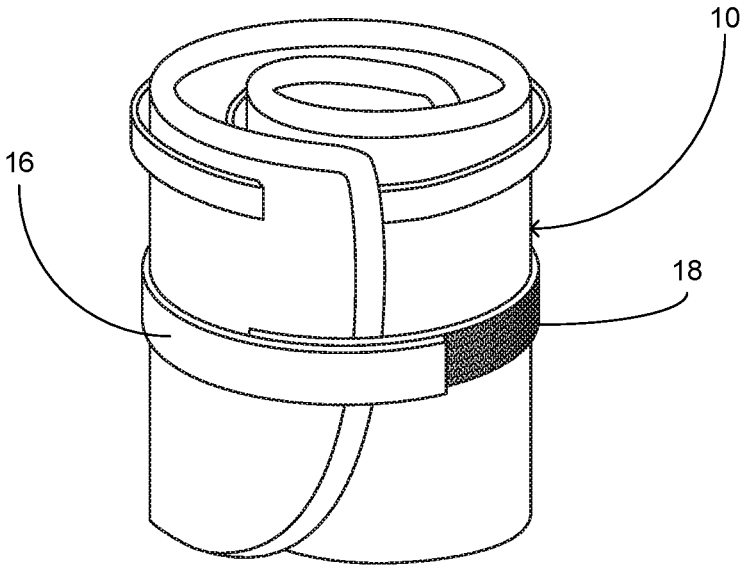
FIG. 4 is a perspective view of the present invention in a rolled position.

Secured to the first end 8 of the body 10 is fill nozzle 25. Fill nozzle 25 is configured to assist in the directional pouring of the fuel disposed within the interior volume 13 of the body 10. The fill nozzle 25 is manufactured from a fuel resistant plastic or other suitable material. The fill nozzle 25 is movable intermediate an extended position and a retracted position (illustrated herein in FIG. 3) wherein in the retracted position the fill nozzle 25 is slidably retracted into the dip tube 40. The fill nozzle 25 includes hollow passage 30 extending therethrough that is fluidly coupled to the interior volume 13 of the body 10 so as to allow both the ingress and egress of fluid. End 27 of fill nozzle 25 includes block member 28 that is configured to inhibit fluid passing therethrough. Block member 28 is semicircular in shape and is configured to move with respect to the second block member 48 of dip tube 40 so as to allow fluid to flow through the fill nozzle 25 or inhibit the flowing of fluid through the fill nozzle. End 27 includes a raised ridge 31 and an o-ring 32 that are configured to provide a seal against the collar 30 when the fill nozzle is moved to its extended position.

At the base of the fill nozzle 25 is collar 30. Collar 80 is sealably coupled to the wall 11 of the body 10 utilizing suitable techniques. By way of example but not limitation, a cap or similar element could be sealably secured to the fill nozzle 25. The collar 80 is formed to be sealably coupled with o-ring 32 when the fill nozzle is in its extended position so as to inhibit the leakage of fluid therefrom.

Figure 2:
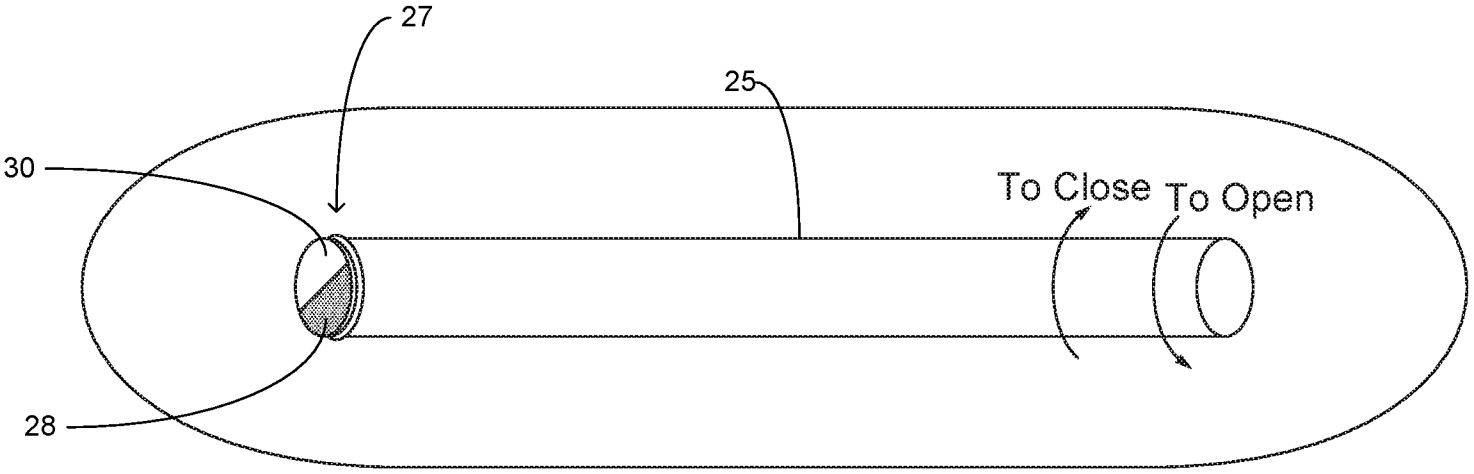
FIG. 2 is a side view of the fill nozzle of the present invention.

The dip tube 40 is disposed within the interior volume 13 of the body 10 and is an elongated hollow tube manufactured from a suitable flexible fuel resistant material. The dip tube 40 extends so as to be proximate the second end 9 of the body 10 and is operable to provide a technique to ensure egression of fluid from the interior volume 13. The dip tube 40 includes the second block member 48 that is semicircular in shape and configured to block one half of the end 49. As shown herein in FIG. 2, the fill nozzle 25 is rotatable with respect to the dip tube 40. The fill nozzle 25 is rotated intermediate a first position and a second position. In its first position the block member 40 and second block member 48 are opposedly located and as such inhibit the flow of fluid through the fill nozzle 25. In its second position the fill nozzle 25 is rotated such that the block member 40 and block member 48 are aligned so as to allow fluid to flow through the hollow passage 30. It should be understood that the block member 40 and block member 48 could be formed in the illustrated positions utilizing various suitable techniques and could be manufactured from plastic or other suitable material.

Secured to the body 10 proximate the second end 9 thereof is handle 60. Handle 60 is operable to provide an element for engagement by a user when the collapsible fuel container 100 is in its second position and the user is transferring fuel from the collapsible fuel container 100 to another fuel tank. The handle 60 is manufactured from a durable flexible material such as but not limited to rubber. It is contemplated within the scope of the present invention that the handle 60 could be formed in alternate shapes and sizes but it is preferred to be manufactured from a flexible material so as to reduce interference with the ability to transition the body 10 into its first position. While no particular length of the body 10 is required, in a preferred embodiment the body 10 is approximately eighteen inches in length.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A liquid container that is configured to be transitioned intermediate a first position and a second position comprising:

a body, said body having a wall, said wall defining an interior volume of the body, said body being manufactured from a flexible material, said body having a first end and a second end;

a dip tube, said dip tube extending into said body, said dip tube having a first end and a second end, said dip tube having a hollow passage therethrough;

a fill nozzle, said fill nozzle being slidably engaged with the hollow passage of said dip tube, said fill nozzle movable between an extended and a retracted position, said fill nozzle having a first end and a second end, said fill nozzle being hollow, said fill nozzle further configured to be rotatable within said hollow passage of said dip tube;

a first block member and a second block member, said first block member being formed on said fill nozzle, said second block member being formed on said dip tube; and wherein in said first position of the liquid container said body is in a rolled position.

2. The liquid container as recited in claim 1, wherein said first block member is formed on said second end of said fill nozzle.

3. The liquid container as recited in claim 2, wherein said second block member is formed on said second end of said dip tube.

4. The liquid container as recited in claim 3, wherein said fill nozzle has an opening at said second end and said first end.

5. The liquid container as recited in claim 4, wherein said wherein said dip tube has an opening at said first end and said second end.

6. The liquid container as recited in claim 5, wherein said first block member is configured to obstruct half of the opening at said second end of said fill nozzle and wherein said second block member is configured to obstruct half of the opening at said second end of said dip tube.

7. The liquid container as recited in claim 6, wherein said fill nozzle is rotatable so as to place the first block member diametrically opposite the second block member in order to inhibit fluid flow through the fill nozzle.

8. A collapsible fuel container that is configured to be movable intermediate a first position and a second position wherein in the first position the collapsible fuel container is rolled for storage wherein the collapsible fuel container comprises:

a body, said body having a wall, said wall defining an interior volume of the body, said body being manufactured from a flexible material, said body having a first end and a second end, said body being manufactured from a flexible material;

a fill nozzle, said fill nozzle being sealably coupled at a base thereof to said body proximate said first end thereof, said fill nozzle having a hollow passage therethrough, said fill nozzle having a first end and a second end, said fill nozzle having an opening at said first end and said second end, said fill nozzle having a first block member formed on said second end, said first block member configured to restrict half of the opening at said second end of said fill nozzle, thereof;

a dip tube, said dip tube being disposed within the interior volume of said body, said dip tube having a first end and a second end, said dip tube having an opening at said first end and said second end, said dip tube having a hollow passage between said first end and said second end, said dip tube configured to movably receive said fill nozzle therein, said dip tube having a second block member formed on said second end, said second block member configured to obstruct half of the opening of said dip tube on said second end thereon; and wherein in said fill nozzle is slidable and rotatable within said dip tube.

9. The collapsible fuel container as recited in claim 8, wherein said fill nozzle is rotatable within said dip tube so as to position said first block member and said second block member in a diametrically opposed position to inhibit flow of fuel through said fill nozzle.

10. The collapsible fuel container as recited in claim 9, wherein said first block member is semi-annular in shape.

11. The collapsible fuel container as recited in claim 10, wherein said second block member is semi-annular in shape.

12. The collapsible fuel container as recited in claim 11, and further including a handle, said handle being secured to said body, said handle being distally located from said fill nozzle, said handle being manufactured from a flexible material.

13. The collapsible fuel container as recited in claim 12, and further including a holding aperture, said holding aperture being sealably formed through said body, said holding aperture configured to be engaged by a finger of a human hand.

14. The collapsible fuel container as recited in claim 13, wherein said body further has a first strap and a second strap, said first strap and said second strap being opposedly located on said body, said first strap and said second strap configured to maintain the collapsible fuel container in said first position.

* * * * *